US005829198A

United States Patent [19]

Watanabe

[11] Patent Number: 5,829,198

[45] Date of Patent: Nov. 3, 1998

[54] OPENING AND CLOSING DEVICE FOR VEHICLE SLIDING DOOR

[75] Inventor: Mitsuhiro Watanabe, Yamanashi-ken, Japan

[73] Assignee: Mitsui Kinzoku Kogyo Kabushiki Kaisha, Tokyo, Japan

[21] Appl. No.: 784,377

[22] Filed: Jan. 17, 1997

[30] Foreign Application Priority Data

Jan. 18, 1996 [JP] Japan ..... 8-024597

[51] Int. Cl.[6] ..... E05F 15/14

[52] U.S. Cl. ..... 49/280; 49/141

[58] Field of Search ..... 49/139, 360, 140, 49/141, 503, 279, 280; 292/201, 216, DIG. 23, DIG. 25, DIG. 46

[56] References Cited

U.S. PATENT DOCUMENTS 5,203,112 4/1993 Yamagishi et al. .
5,239,779 8/1993 DeLand et al. .

*Primary Examiner*—Daniel P. Stodola
*Assistant Examiner*—Curtis Cohen
*Attorney, Agent, or Firm*—Browdy and Neimark

[57] ABSTRACT

An opening and closing device for a vehicle sliding door slidably attached to a vehicle body. The device has a latch engageable with a striker, a ratchet engageable with the latch for maintaining the engagement between the latch and the striker, a first motor, a second motor, a wire drum rotated by the first motor, a wire cable provided between the sliding door and the wire drum for pulling the sliding door toward an open position or close position thereof when the wire drum is rotated, a power transmission provided between the second motor and the latch for turning the latch from a half-latch position to a full-latch position under power of the second motor, a safety lever operatively connected to the open handle for cutting off the power transmission when the open handle is manipulated, detecting apparatus for detecting actuation of the safety lever, and a control for operating the first motor to move the sliding door toward the open position when the detecting apparatus senses activation of the safety lever.

6 Claims, 5 Drawing Sheets

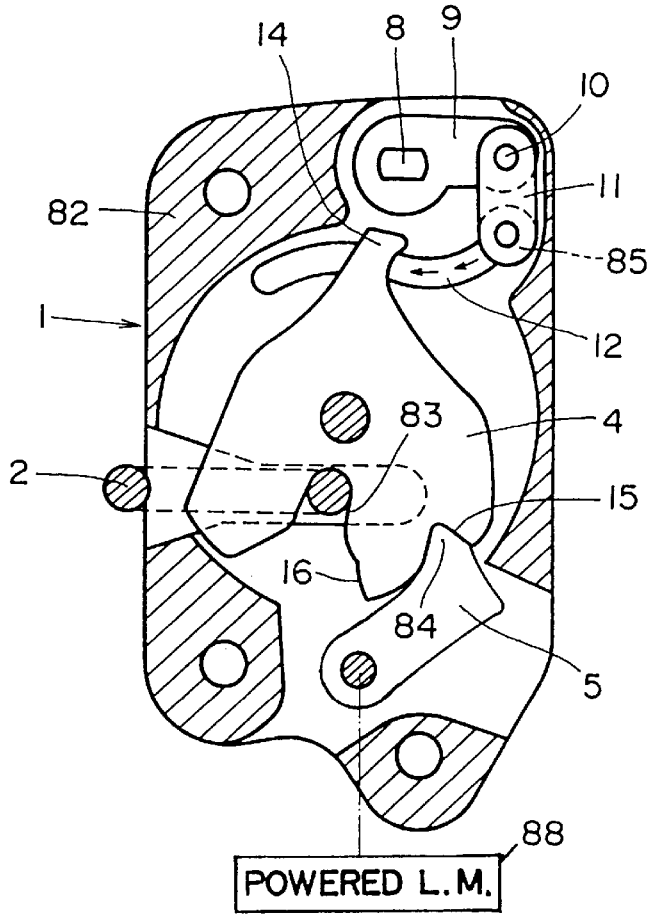
FIG. 2
FIG. 6
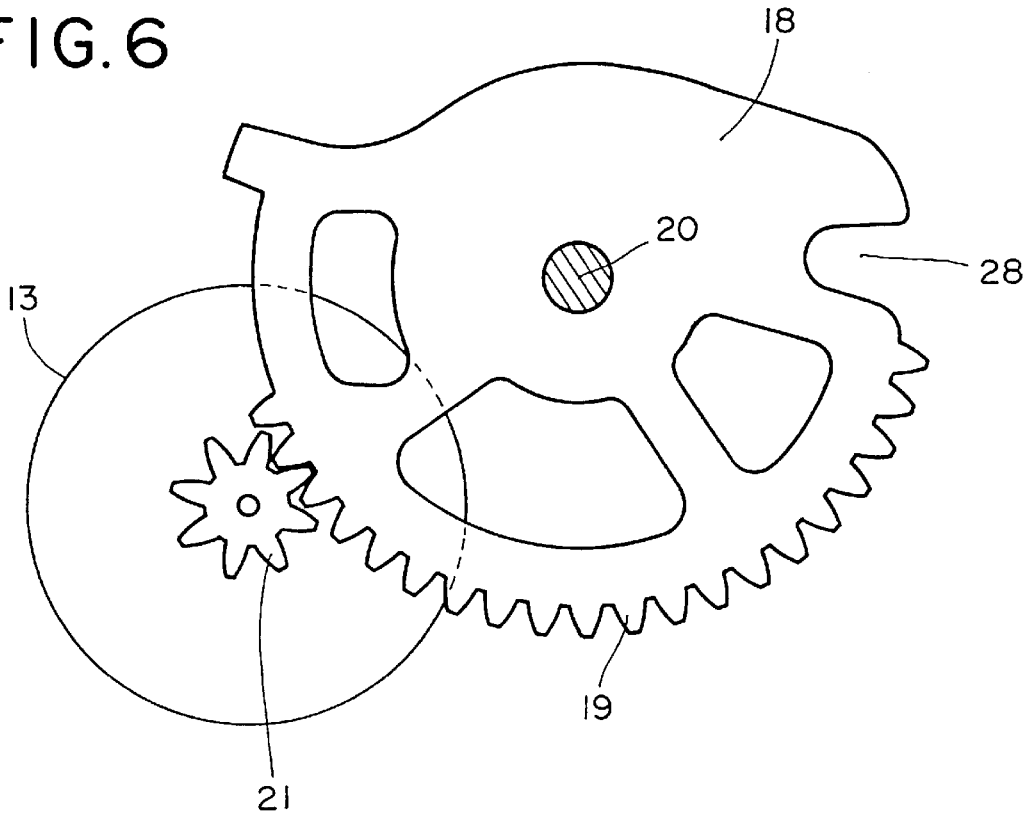

OPENING AND CLOSING DEVICE FOR VEHICLE SLIDING DOOR

BACKGROUND OF THE INVENTION

The present invention relates to an opening and closing device for a vehicle sliding door.

RELATED ART

In general, for moving a sliding door slidably attached to a vehicle body a stronger force is required than for a swinging door attached to a vehicle body through the intermediary of hinges since the moving resistance of the sliding door is larger. Accordingly, over the years motor driven devices for opening and closing a sliding door have been attached to the sliding door to facilitate openings. There have proposed several devices for opening and closing a sliding door as disclosed, for example, in U.S. Pat. No. 5,239,779 and U.S. Pat. No. 5,203,112.

The above-mentioned opening and closing device, for moving a sliding door from a full-open position to a full-close position under power of a motor, is incorporated therein with a safety device for stopping the movement of the sliding door due to an obstruction. Such a safety device is adapted to be manually or automatically operated if a hand or a finger is caught between the sliding door and the vehicle body, for example. The conventional safety device is adapted to cut off power transmission between the motor and the sliding door, and simultaneously, a latch of the door is released so as to freely move the sliding door. However, even with this precaution, the hand and the finger can still be caught between the sliding door and the vehicle body. That is, a relative large force is required for opening the sliding door and accordingly, it requires manually movement of the sliding door to remove a hand or a finger is still caught between the sliding door and vehicle body even though the sliding door is free.

SUMMARY OF THE INVENTION

Accordingly, the object of the present invention is to provide a device for opening and closing a vehicle sliding door, which slides the sliding door toward its open position under power of a motor when a safety device is manually or automatically actuated.

BRIEF DESCRIPTION OF THE INVENTION

The above and other objects, features and advantages of the present invention will become apparent from the detailed description of the preferred embodiments found below with reference to the accompanying drawings in which:

FIG. 2 is a longitudinally sectioned front view illustrating a latch unit;

FIG. 6 is an enlarged view illustrating the sector gear; and

DESCRIPTION OF THE PREFERRED EMBODIMENTS

Figure 1:
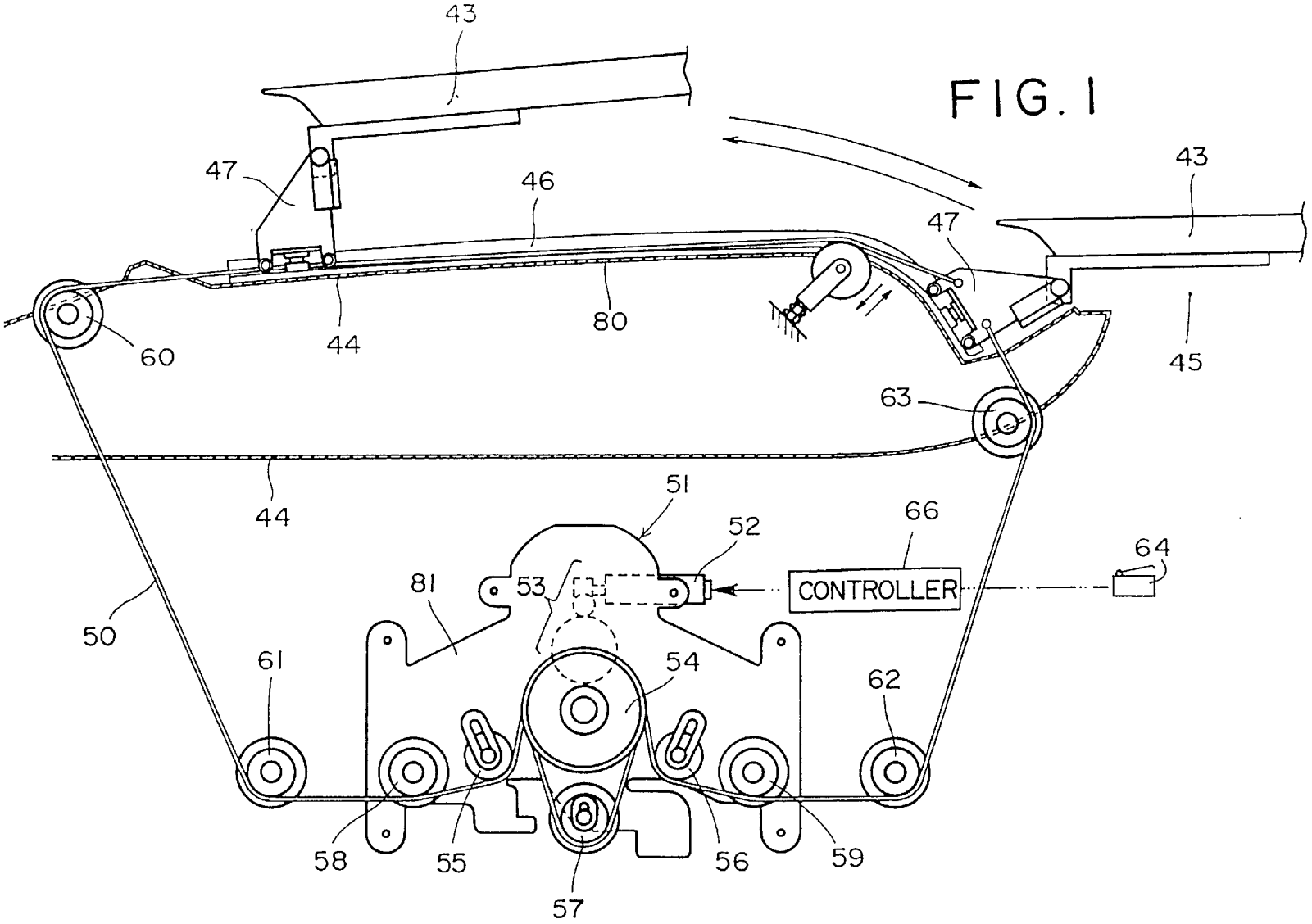
FIG. 1 is an developed view illustrating a rear outer side panel, a sliding door and a power sliding unit.

An embodiment of the present invention will be described with reference to the accompanying drawings. FIG. 1 shows a rear outer side panel or a quarter panel 80 of a vehicle body 44 and a sliding door 43 which is slidably attached to the vehicle body 44. A guide rail 46 extending in the longitudinal or front-and-rear direction of the vehicle body 44 is secured to the side panel 80. A coupling bracket 47 rotatably attached to the sliding door 43 is slidably engaged the guide rail 46. The sliding door 43 is slid between a full-open position where it faces the side panel 80 and a full-close position or a full-latch position where it closes a door opening 45 of the vehicle body 44.

FIG. 1 also shows a powered sliding unit 51 for sliding the door 43. The sliding unit 51 and the coupling bracket 47 of the slide door 43 are connected with each other by a wire cable 50. When the wire cable 50 is pulled by the slide unit 51, the coupling bracket 47 is moved along the guide rail 46, and accordingly, the sliding door 43 is slid back and forth.

Front side pulleys 62, 63 for the cable 50 are arranged in the vicinity of the front end part of the guide rail 46, and rear side pulleys 60, 61 for the cable 50 are arranged in the vicinity of the rear end part of the guide rail 46.

The powered sliding unit 51 has a base plate 81 fixed to the vehicle body 44, a reversible motor 52, a wire drum 54 journalled to the base plate 81 and wound thereon with the wire cable 50 by several turns, a speed reduction mechanism 53 provided between the reversible motor 52 and the wire drum 54, a pair of first tension rollers 55, 56 attached to the base plate 81, a pair of guide pulleys 58, 59 journalled to the base plate 81, and a second tension roller 57 attached to the base plate 81.

The sliding door 43 is attached thereto with a latch unit 1 which is adapted to be engaged with a striker 2 secured to the vehicle body 44 so as to hold the sliding door 43 in its closed position. The latch unit 1 comprises a latch 4 engaged with the striker 2, and a ratchet 5 engaged with the latch 4 for holding the engagement between the latch 4 and the striker 2. The latch 4 and the ratchet 5 are rotatably attached to a latch body 82 of the latch unit 1. Referring to FIG. 2, the latch 4 is urged clockwise by a resilient force of a spring (not shown), and the ratchet 5 is urged counterclockwise by a resilient force of a spring (not shown)

When the sliding door 43 is slid toward the closed position, the striker 2 is engaged in an U-like groove 83 of the latch 4 so as to turn the latch 4 counterclockwise, then the ratchet 5 is engaged with the latch 4 so as to prevent the latch 4 from reversing. The engagement between the latch 4 and the ratchet 5 includes two kinds of engagement, that is, a half-latch engagement as an initial engagement in which a pawl portion 84 of the ratchet 5 is engaged with a half-latch step part 15 of the latch 4, and a full-latch engagement as a complete engagement in which the pawl portion 84 is engaged with a full-latch step part 16 of the latch 4. The sliding of the door 43 toward the closed position by the powered sliding unit 51 is carried out until the half-latch engagement is attained. When the half-latch engagement is completed, the operation of the powered sliding unit 51 is stopped.

FIGS. 3 to 7 show a powered closing unit 3 for displacing the sliding door 43 from a half-latch position where the half-latch engagement is attained to a full-latch position where the full-latch engagement is attained. A wire cable 6 is laid between the powered closing unit 3 and the latch unit 1, for transmitting a power from the powered closing unit 3 to the latch unit 1, and accordingly, the latch 4 of the latch unit 1 can be turned toward the full-latch position under the power of the powered closing unit 3.

Figure 5:
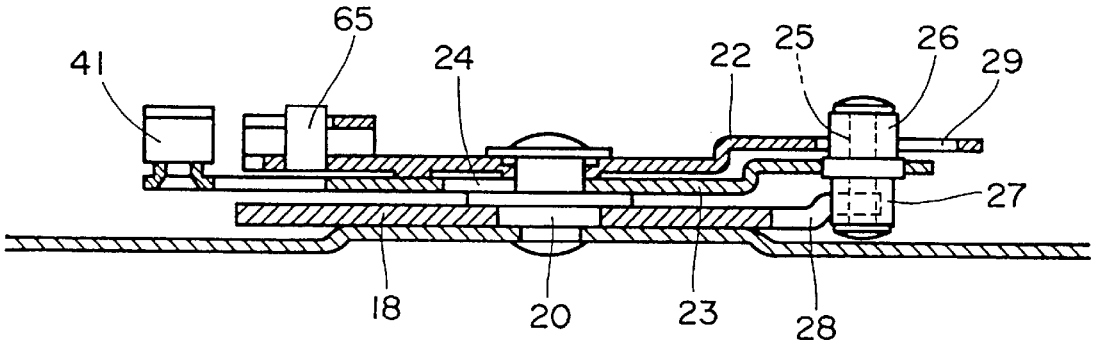
FIG. 5 is a sectional view illustrating the winch lever, the connecting lever and a sector gear.

The powered closing unit 3 comprises a base plate 17 secured to the sliding door 43, and a motor 13 attached to the base plate 17. A gear part 19 of a sector gear 18 is meshed with an output gear 21 of the motor 13. The sector gear 18 is journalled to the base plate 17 through the intermediary of a shaft 20. A winch lever 22 is rotatably journalled to the shaft 20 and is engaged thereto with one end 65 of the wire cable 6. A connecting lever 23 is provided between the winch lever 22 and the sector gear 18, as shown in FIG. 5. The connecting lever 23 is formed therein with an elongated hole 24 through which the shaft 20 pierces. The connecting lever 23 is slidable by a distance equivalent to a length of a play obtained between the elongated hole 24 and the shaft 20.

The connecting lever 23 is provided at one end thereof with a pin 25 (see FIG. 5) which is projected from the opposite sides of the connecting lever 23. An upper roller 26 slidably engaged in an elongated hole 29 in the winch lever 22, and a lower roller slidably engaged in a U-like groove 28 of the sector gear 18 are rotatably fitted on an upper portion and a lower portion of the pin 25, respectively (see FIG. 5). A spring 32 is stretched between a bent piece 30 of the connecting lever 23 and a protrusion 31 of the winch lever 22 so as to urge the connecting lever 23 in a direction of the arrow W. The engagement between the lower roller 27 and the U-like groove 28 of the sector gear 18 is held by the resilient force of the spring 32.

Figure 3:
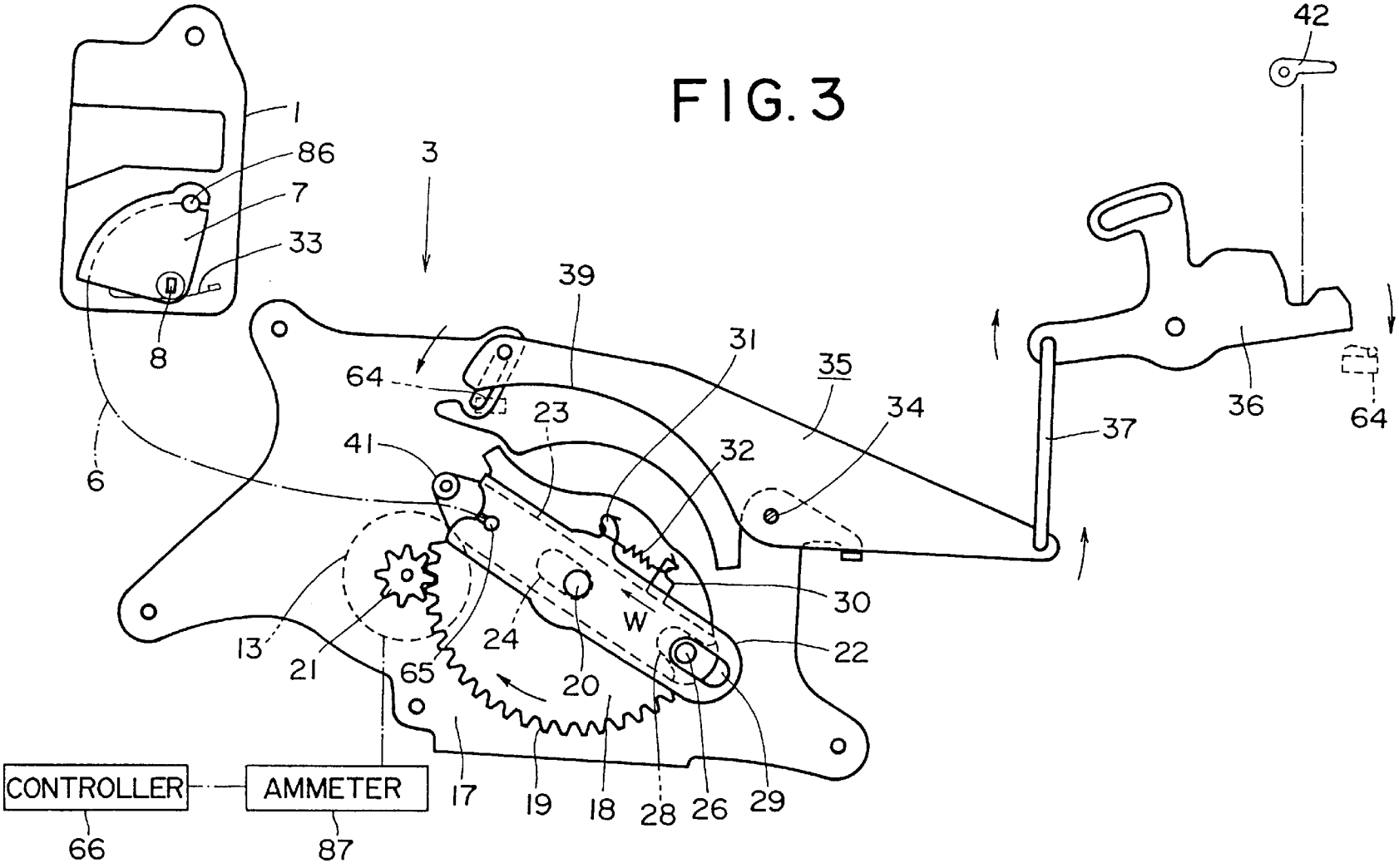
FIG. 3 is a front view illustrating a powered closing unit.
Figure 4:
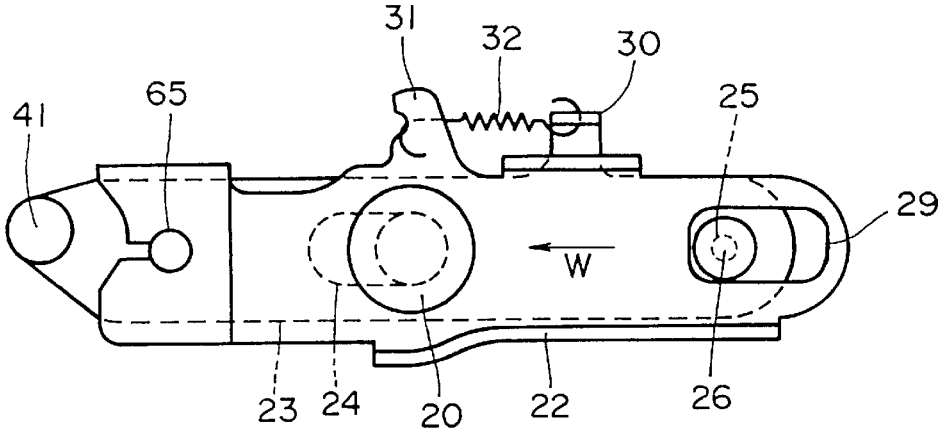
FIG. 4 is an enlarged view illustrating a winch lever and a connecting lever in the powered closing unit.

The motor 13 of the powered closing unit 3 is rotated when the latch unit 1 falls into the half-latch condition, and accordingly, the sector gear 18 is rotated clockwise as viewed in FIG. 3. Then, since the lower roller 27 of the connecting lever 23 is engaged with the groove 28 of the sector gear 18, the connecting lever 23 is rotated clockwise and the upper roller 26 of the connecting lever 23 turns the winch lever 22 clockwise so as to pull the wire cable 26. Thus, power is transmitted from the motor 13 to the latch unit 1.

A cable lever 7 is journalled to the rear side of the latch body 82 through the intermediary of a shaft 8. The cable lever 7 is clockwise urged by the resilient force of a spring 33. The cable lever 7 is coupled thereto with the other end 86 of the wire cable 6. The shaft 8 is secured thereto with a rotary arm 9 (see FIG. 2) which is rotated integrally with the cable lever 7. The rotary arm 9 is connected thereto with a link 11 to which a roller 85 is attached. When the rotary arm 9 is rotated, the roller 85 is moved along a guide groove 12 formed in the latch body 82. The latch is provided with a leg part 14 which overlaps with the guide groove 12 when the latch 4 turns to the half-latch position.

When the latch unit 1 falls into the half-latch condition, the wire cable 6 is pulled under the power of the motor 13 of the powered closing unit 3 so as to turn the cable lever 7 and the rotary arm 9. Then, the roller 85 moves along the guide groove 12 and makes contact with the leg part 14 of the latch 4. Thereby the latch 4 is turned to the full-latch position from the half-latch position. Then, the pawl portion 84 of the ratchet 5 is engaged with the full-latch step part 16 of the latch 4.

The powered closing unit 3 is provided therein with a safety lever 35 for cutting off the power transmission between the motor 13 and the latch unit 1. The safety lever 35 is journalled to the base plate 17 through the intermediary of a shaft 34. The safety lever 35 is connected by a rod 37 to an open lever 36 which is adapted to be turned by means of an outer open handle or an inner open handle 42 of the sliding door 43. The open lever 35 shown in FIG. 3 is separated from the latch unit 1, but it is usually provided on the rear side of the latch unit 5 and is operatively connected to the ratchet 5 so as to release the ratchet 5 from the latch 4 when the open handle 42 is turned.

Figure 7:
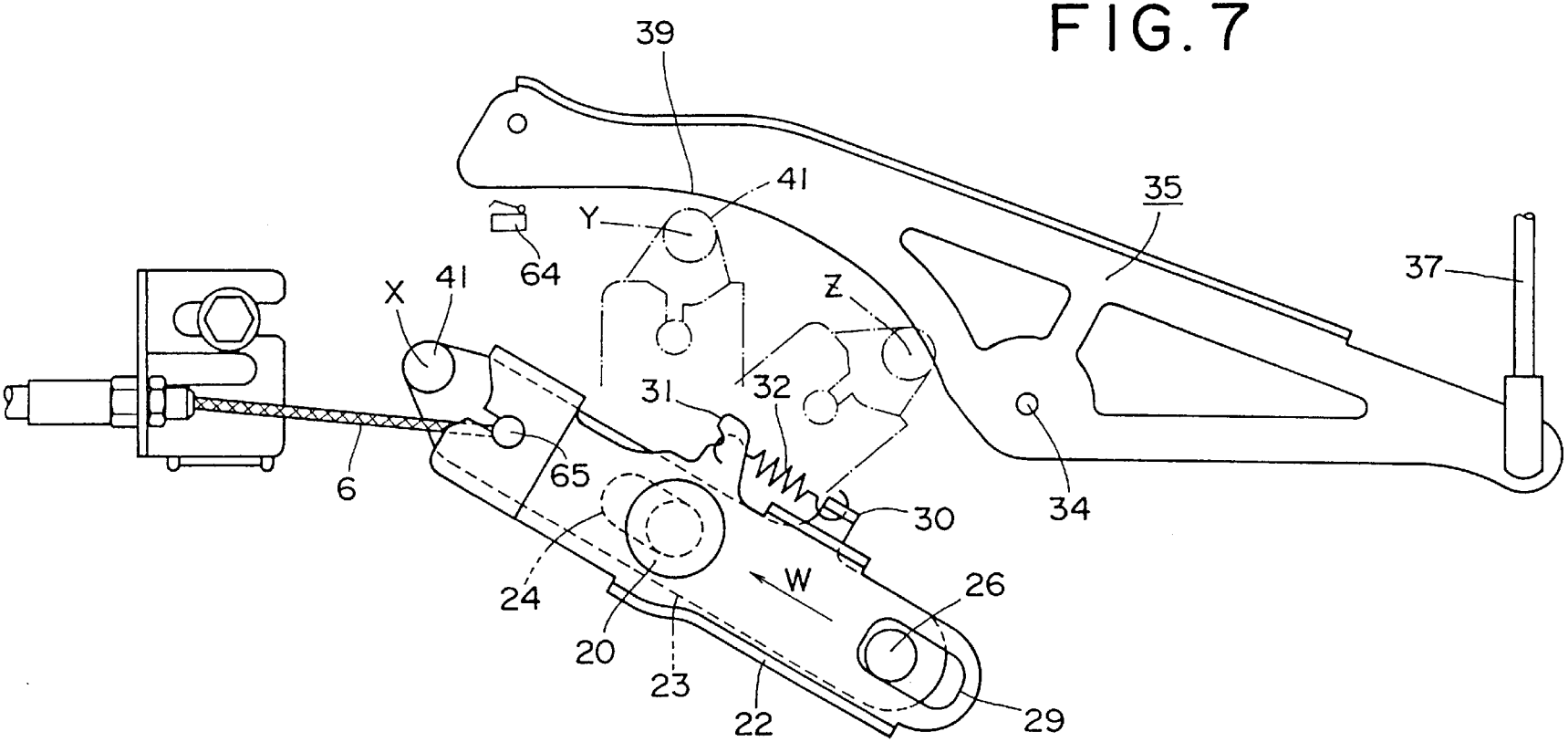
FIG. 7 is an explanatory view for a safety mechanism.

The safety lever 35 is formed therein with a contact surface 39 which is an arcuate shape which is substantially coincident with the moving locus of a cancelling roller 41 of the connecting lever 23, as shown in FIG. 7. The cancelling roller 41 is held at a standby position as indicated by X shown in FIG. 7, under the resilient force of the spring 33 in the latch unit 1 when the motor 13 is deenergized. When the connecting lever 23 is turned clockwise and the cancelling roller 41 moves to a position Y, the roller 85 abuts against the leg part 14 of the latch 4 at the half-latch position. When the cancelling roller 41 has been moved to a position Z, the roller 85 moves the latch 4 counterclockwise to the full-latch position.

When the cancelling roller 41 of the connecting lever 23 is on the way between the position Y and the position Z, if the open lever 36 is turned by means of the open handle 42, the safety lever 35 is turned counterclockwise about the shaft 34 as a center so that the contact surface 39 of the safety lever 35 abuts against the cancelling roller 41 of the connecting lever 23. Thereby the connecting lever 23 is slid in the direction opposite to the arrow W against the resilient force of the spring 32. Then, the lower roller 27 of the connecting lever 23 is separated from the groove 28 of the sector gear 18, and the connecting lever 23 and the sector gear 18 are disengaged from each other. That is, the power transmission between the motor 13 and the latch unit 1 is cut off. As a result, even though a hand or a finger is caught between the sliding door 43 and the vehicle body 44 during movement of the sliding door 43 by the powered closing unit 3 from the half-latch position to the full-latch position, the hand and the finger can be prevented from being seriously injured, by manipulating the open handle 42 of the sliding door 43 with no flurry.

In general, the sliding door has a moving resistance which is greater than that of a swinging door attached to a vehicle body by means of hinges, and accordingly, a larger force is required for moving the sliding door. Therefore, the swinging door can be displaced toward its open position by a certain degree by an impact resilient force of a seal member provided between the swinging door and the vehicle body when a latch of the swinging door is released by manipulating the open handle. However the sliding door does not appreciably move unless it is purposely moved even though the latch is released by manipulating the open handle. Thus, as mentioned above, in such a case that a hand or a finger would be caught between the sliding door 43 and the vehicle body 44, even though the power transmission between the motor 13 and the latch unit 1 is cut off by the safety lever 35, the hand or the finger would be still caught between the sliding door 43 and the vehicle body 44. Thus, according to the present invention, the sliding door 43 is moved to the full-open position by the powered sliding unit 51 when the power transmission between the motor 13 and the latch unit 1 is cut off by the safety lever 35. A switch or a sensor 64 for detecting the operation of the safety lever 35 is provided at a position in the vicinity of the safety lever 35, the open lever 36, the open handle 42 or the connecting lever 23. A signal is transmitted from the switch 64 to a controller 66 for the powered sliding unit 51. When the signal is delivered to the controller 66, the motor 52 is reversed, and accordingly, the sliding door 43 is moved to the full-open position.

According to the present invention, if a hand or a finger is caught between the sliding door 43 and the vehicle body 44, the power transmission of the powered closing unit 3 can be cut off. However, an assumption would be made such that a person whose hand or finger is caught therebetween falls into a panic, and accordingly, he cannot manipulates the open handle 42. Accordingly, in the present invention, when an abnormal affair occurs, the sliding door 43 can be automatically moved to the full-open position. Such abnormal closing of the sliding door 43 can be detected by an amperemeter 87 connected to the motor 13 of the powered closing unit 3. When a current value detected by the amperemeter 87 exceeds a predetermined value, it is regarded that an abnormal closing of the sliding door 43 occurs. A powered releasing means 88 having a motor or solenoid is operatively connected to the ratchet 5 of the latch unit 1. When the amperemter 87 detects an abnormal current value, the controller 66 energizes the powered releasing means 88 so as to release the ratchet 5 from the latch 4, and then, it reverse the motor 52 so as to move the sliding door 43 toward the full-open position. Abnormal closing of the sliding door 43 can also be detected by monitoring the rotational speed of the motor 13.

The foregoing discussion discloses and describes merely exemplary embodiment of the present invention only. One skilled in the art will readily recognize from such discussion, and from the accompanying drawings and claims, that various changes, modifications and variations can be made therein without departing from the spirit and scope of the invention as defined in the following claims.

What is claimed is:

1. An opening and closing device on a vehicle sliding door slidably attached to a vehicle body, comprising:

a latch rotatably attached to the sliding door and engageable with a striker secured to the vehicle body when the sliding door is closed, said latch having an open condition in which the latch is disengaged with the striker, a half-latch condition in which the latch is initially engaged with the striker and a full-latch condition in which the latch is completely engaged with the striker;

a ratchet rotatably attached to the sliding door and engageable with the latch for maintaining the engagement between the latch and the striker;

an open handle provided on the sliding door and operatively connected to the ratchet for releasing the ratchet from the latch;

a first motor provided in the vehicle body;

a wire drum provided in the vehicle body and rotated by the first motor;

a wire cable provided between the wire drum and the sliding door for pulling the sliding door toward an open position or closed position when the wire drum is rotated;

a second motor provided in the sliding door;

a power transmission provided between the second motor and the latch for causing the latch to displace from the half-latch condition into the full-latch condition under power of the second motor;

a safety lever operatively connected to the open handle for cutting off the power transmission when the open handle is actuated;

a detecting means for detecting an operation of the safety lever; and a control means for operating the first motor to move the sliding door toward the open position when the detecting means senses actuation of the safety lever.

2. A device as set force in claim 1, further comprising a powered releasing means operatively connected to the ratchet for releasing the ratchet from the latch, and a monitor means for detecting abnormal closing of the sliding door by monitoring a rotating condition of the second motor, wherein when said monitor means detects abnormal closing of the sliding door, said control means operates the powered releasing means to release the ratchet and operates the first motor to move the sliding door toward the open position.

3. A device as set forth in claim 1, wherein said power transmission comprises a first member operatively connected to the second motor, a second member operatively connected to the latch and a connecting member having a connecting position where the first member is connected with the second member and a disconnecting position where the first member is disconnected from the second member, said connecting member being operatively connected to the safety lever so that the connecting member is displaced from the connecting position into the disconnecting position when the safety lever is moved.

4. A device as set forth in claim 1, wherein said detecting means is a switch which is pushed by the safety lever.

5. A device as set forth in claim 1, wherein said detecting means is a switch which is pushed by the open handle.

6. A device as set forth in claim 3, wherein said detecting means is a switch which is pushed by the connecting member.

* * * * *